United States Patent [19]

Muncaster et al.

[11] Patent Number: 4,508,770

[45] Date of Patent: Apr. 2, 1985

[54] ROAD REPAIR MATERIAL OF KNITTED UNIDIRECTIONAL GLASS ROVING MAT COATED WITH ELASTOMERIC MODIFIED ASPHALT

[75] Inventors: John W. Muncaster, Columbus; Michael G. Roberts, Heath; R. David Rowlett, Granville; Todd B. Hoitink, Columbus; William E. Uffner, Newark; Robert N. White, Etna, all of Ohio

[73] Assignee: Owens-Corning Fiberglas Corporation, Toledo, Ohio

[21] Appl. No.: 590,674

[22] Filed: Mar. 19, 1984

[51] Int. Cl.[3] ..... B32B 3/26

[52] U.S. Cl. ..... 428/63; 404/72; 404/75; 404/134; 428/253; 428/254; 428/489

[58] Field of Search ..... 428/63, 253, 254, 489; 404/72, 75, 134

[56] References Cited

U.S. PATENT DOCUMENTS 3,930,100 12/1975 McDonald ..... 428/63

*Primary Examiner*—Marion E. McCamish

*Attorney, Agent, or Firm*—Ronald C. Hudgens; Ted C. Gillespie; Paul J. Rose

[57] ABSTRACT

A knitted unidirectional mat of glass rovings, factory coated with elastomeric modified asphalt, is used to reinforce a crack in an old road before applying a new layer of asphalt-based pavement.

2 Claims, No Drawings

ROAD REPAIR MATERIAL OF KNITTED UNIDIRECTIONAL GLASS ROVING MAT COATED WITH ELASTOMERIC MODIFIED ASPHALT

TECHNICAL FIELD

This invention relates generally to road repairing, and more particularly to a material for and method of treating cracks in an old road surface before applying a new asphalt-based top layer.

BACKGROUND ART

When old cracked roads are resurfaced with a new asphalt-based top layer, many times the new layer cracks directly over the cracks in the old road. One way to prevent this reflective cracking in the new layer is to make the new layer thicker, but a more practical method is to reinforce the old road at the cracks before applying the new layer. One system which has been used comprises pouring hot liquid elastomeric modified asphalt on the old road over a crack and squeegeeing it out to about six inches on each side, applying a strip of woven glass roving over the elastomeric modified asphalt on the road, applying more hot liquid elastomeric modified asphalt over the woven glass roving, and then putting down the new layer of asphalt-based pavement.

DISCLOSURE OF THE INVENTION

In accordance with the invention, a unidirectional mat of glass rovings is coated with elastomeric modified asphalt in a factory. Hot liquid elastomeric modified asphalt is poured over a crack in an old road and squeegeed out on each side of the crack. The precoated unidirectional glass mat is then placed over the elastomeric modified asphalt on the road with the glass rovings extending as nearly perpendicular to the crack as possible. Finally, the new layer of asphalt-based pavement is applied.

The unidirectional mat of glass rovings is less expensive than woven glass roving, and yet it still provides reinforcement in the most important direction, namely, crosswise of the crack. Because the unidirectional mat is already coated, a second layer of hot liquid modified asphalt need not be applied thereover before the laying of the asphalt-based pavement, as it would with the bare woven glass roving. The quality-controlled precoating in the factory assures adequate wetting-out of the glass mat and also protects the glass fibers from dampness at the site of use.

BEST MODE OF CARRYING OUT THE INVENTION

Knitted unidirectional glass roving mat is cut to a width of about fifteen inches, coated in a factory with elastomeric modified asphalt, and wound into rolls or cut to suitable lengths.

The term "unidirectional mat" is intended to mean mat having its main or stronger threads, strands, or rovings oriented to provide reinforcement in one direction. Weaker threads, strands, or rovings are usually provided in a direction perpendicular to the main threads, strands, or rovings to maintain integrity of the mat during processing. For example, a knitted unidirectional glass roving mat suitable in the practice of Applicants' invention may have its main or stronger glass rovings extending in the fill direction with a distribution of about eight ends per inch and a tensile strength of about 1,000 to 1,150 pounds per inch before coating with elastomeric modified asphalt. In the warp direction, the mat have have tensilized polyester rovings with a distribution of about seven ends per inch and a tensile strength of about 100 to 120 pounds per inch, but preferably, for dimensional stability, the warp rovings are glass rovings with a tensile strength of about 200 to 300 pounds per inch. The warp rovings are all on one side of the mat and the fill rovings are all on the other side of the mat. The warp and fill rovings are knitted together with tensilized polyester thread.

The unidirectional mat of glass rovings suitably has a weight of 12 ounces per square yard and is factory coated with elastomeric modified asphalt. The coated mat weighs about three times as much, or 36 ounces per square yard, and the widthwise strength of the coated mat is about 1300 pounds per inch.

After hot liquid elastomeric modified asphalt is applied over a crack in an old road, strips of the factory coated unidirectional mat of glass rovings are applied over the modified asphalt on the road with the main or stronger glass rovings extending crosswise of the crack. Thereafter a new layer of asphalt-based pavement is laid. Reflective cracking from the crack in the old road to the new asphalt pavement layer is greatly inhibited.

We claim:

1. A knitted unidirectional mat of glass rovings factory coated with elastomeric modified asphalt, for use in road repairing.

2. A method of repairing a crack in an old road before application of a new layer of asphalt-based pavement, the method comprising applying hot liquid elastomeric modified asphalt on the old road on opposite sides of the crack, and applying a knitted unidirectional mat of glass rovings, factory coated with elastomeric modified asphalt, over the elastomeric modified asphalt on the road, with the main or stronger glass rovings extending substantially crosswise of the crack.

* * * * *